United States Patent [19]

Paulson

[11] 4,262,945

[45] Apr. 21, 1981

[54] SAFETY LATCH FOR WASHER CLOSURE

[75] Inventor: Philip D. Paulson, Toronto, Canada

[73] Assignee: Inglis Limited, Toronto, Canada

[21] Appl. No.: 33,947

[22] Filed: Apr. 27, 1979

[51] Int. Cl.[3] ..... E05C 3/16

[52] U.S. Cl. ..... 292/89; 292/DIG. 69

[58] Field of Search ..... 292/336.3, 347, DIG. 63, 292/DIG. 69, 113, 89

[56] References Cited

U.S. PATENT DOCUMENTS

| | | | |
|---|---|---|---|
| 2,519,814 | 8/1950 | Bayless | 292/DIG. 69 |
| 3,088,623 | 5/1963 | Parker | 292/113 X |
| 3,690,709 | 9/1972 | Bogusz | 292/259 X |
| 4,032,180 | 6/1977 | Pohl | 292/DIG. 69 |
| 4,074,545 | 2/1978 | Case | 292/DIG. 69 |

*Primary Examiner*—Richard E. Moore

[57] ABSTRACT

An appliance for cleaning and treating clothes has a housing, a door, and a closure for the door. The closure comprises means for impeding access to a handle portion for the door and a catch secured to the means for releasably securing the door shut. The means is manually movable to gain access to the handle and simultaneously releases the catch.

23 Claims, 14 Drawing Figures

FIG.9.
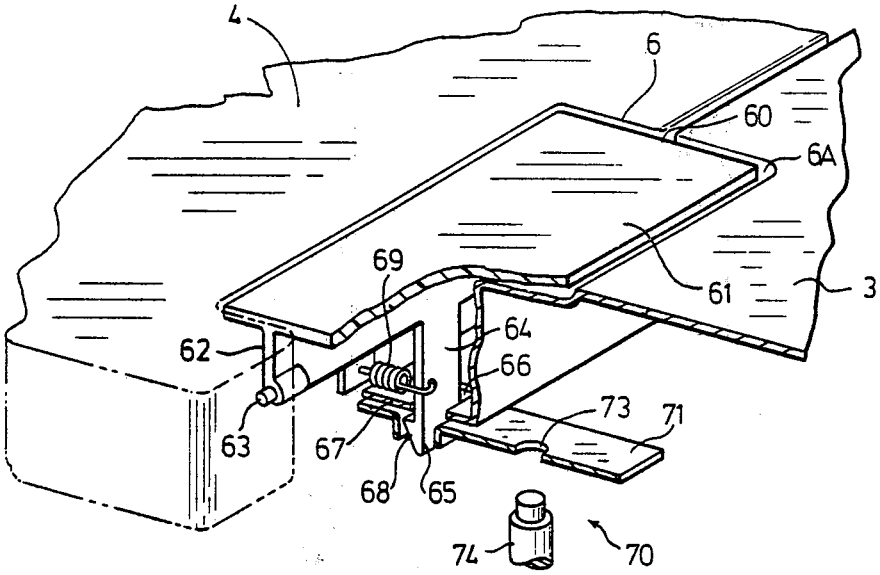
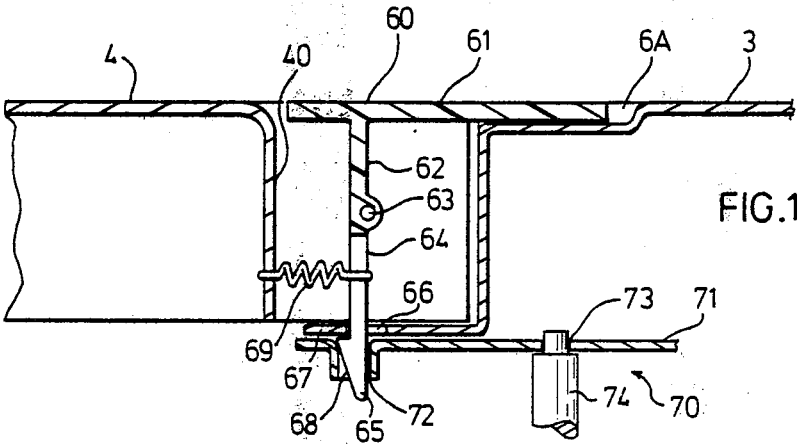
FIG.10.
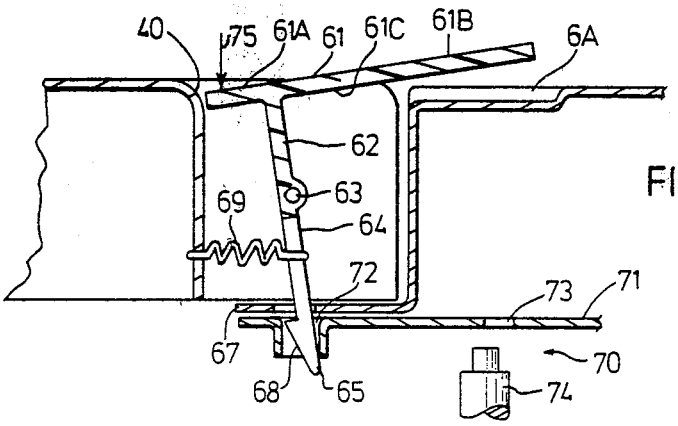
FIG.11.

FIG.12.
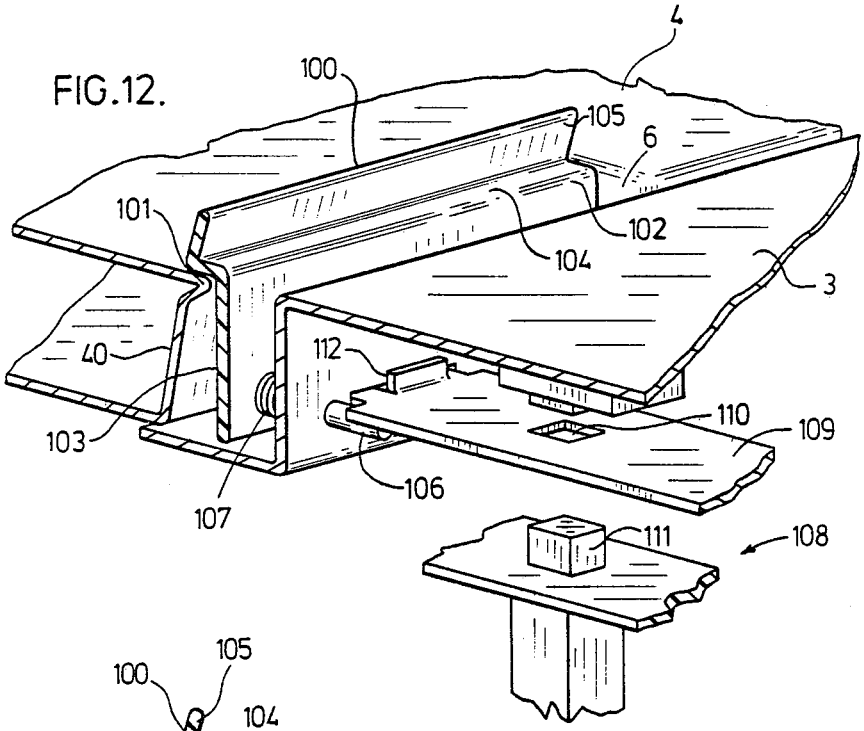
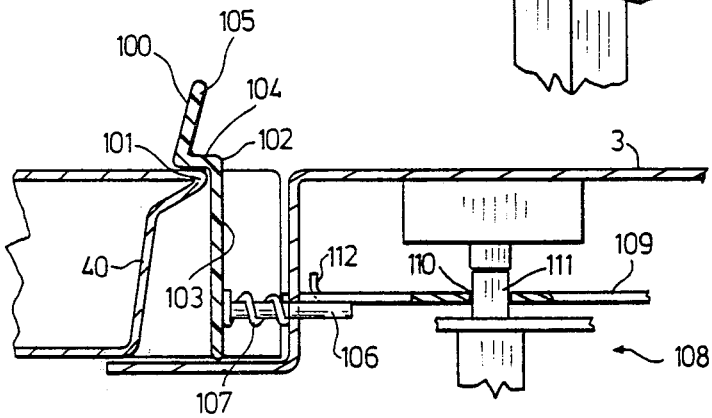
FIG.13.
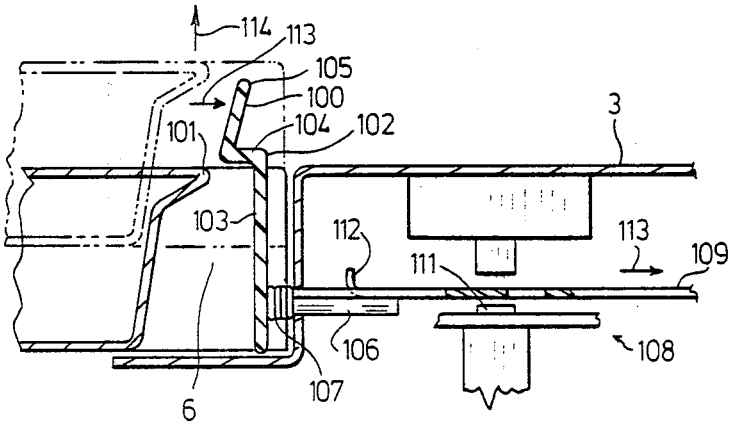
FIG.14.

SAFETY LATCH FOR WASHER CLOSURE

FIELD OF THE INVENTION

The present invention relates to a novel closure or latch for the door of an appliance for cleaning clothes.

BACKGROUND OF THE INVENTION

In automatic washing machines, it is usual to provide a handle on the outer surface of the door controlling access to the washing chamber or to provide a lip projecting into a recessed area along one edge of the door to act as a handle. Washing machines with this type of lid normally have a mechanical brake connected to the cleaning drum which is activated when the door is opened to quickly slow down the drum to allow safe access to the clothes. Recently safety features on clothes cleaning appliances have become a requirement in certain areas. in this regard, a lock has been provided on the door which is activated during the spin cycle and to provide a time delayed release for the lock to ensure that the drum is at rest before the lid can be opened.

SUMMARY OF THE INVENTION

The present invention is directed to providing a closure or latch for an appliance door which can be utilized with locking devices known in the art. The closure provides means which may be in the form of a barrier to impede or prevent access to the handle of the door until the barrier is moved. Movement of the barrier performs the function if allowing access to the handle and releasing a catch which latches the door closed. When used with a locking device, access to the handle is prevented until a hazardous portion of a clothes cleaning or treating cycle is ended. The handle can only be employed as such when the latch is unlocked to allow the barrier to move and permit access to the handle.

Therefore, an aspect of the invention provides an appliance for cleaning clothes having a housing and a door hingedly secured to the housing. The door provides access to a cleaning chamber located in the housing and has an indentation on one side to define a recess. A closure is provided for the door and comprises a catch and a barrier. The catch is adapted to latch the door closed. The barrier is mounted within the recess and is adapted to be movable within the recess. The movement of the barrier is such that the catch is released from a position where it is engaged to latch the door. The movement of the barrier also provides access to a handle for the door. When the catch is engaged to keep the door closed, the barrier impedes access to the handle. Means is provided for the natural return of the barrier from the position where the catch is released to the position where the catch can be operatively engaged.

A further aspect of the present invention provides a latch for the door and comprises a handle portion with depending catch portion and means mounting the handle to the door. The catch portion is adapted to be engaged by locking means located in the housing. The handle portion is biased in a manner whereby the catch portion is engaged by the locking means. The arangement is such that the handle is positioned within the recess of the door to allow the handle to be moved sideways to disengage the catch and to limit access to the handle portion when the door is closed and the catch is secured by the locking means.

DESCRIPTION OF THE DRAWINGS

Preferred embodiments of the invention are shown in the drawings wherein:

FIG. 9 is a perspective view partly in section of a further embodiment of the invention;

FIG. 10 is a plan view of the embodiment illustrated in FIG. 9;

FIG. 11 shows the view of FIG. 10 with the door closed and the latch released;

FIG. 12 is a perspective view partly in section of a further embodiment of the invention;

FIG. 13 is a plan view of the embodiment illustrated in FIG. 12; and

FIG. 14 shows the view of FIG. 13 with door closed, and in dotted lines open and the latch released.

DETAILED DESCRIPTION OF THE PREFERRED EMBODIMENTS

Figure 1:
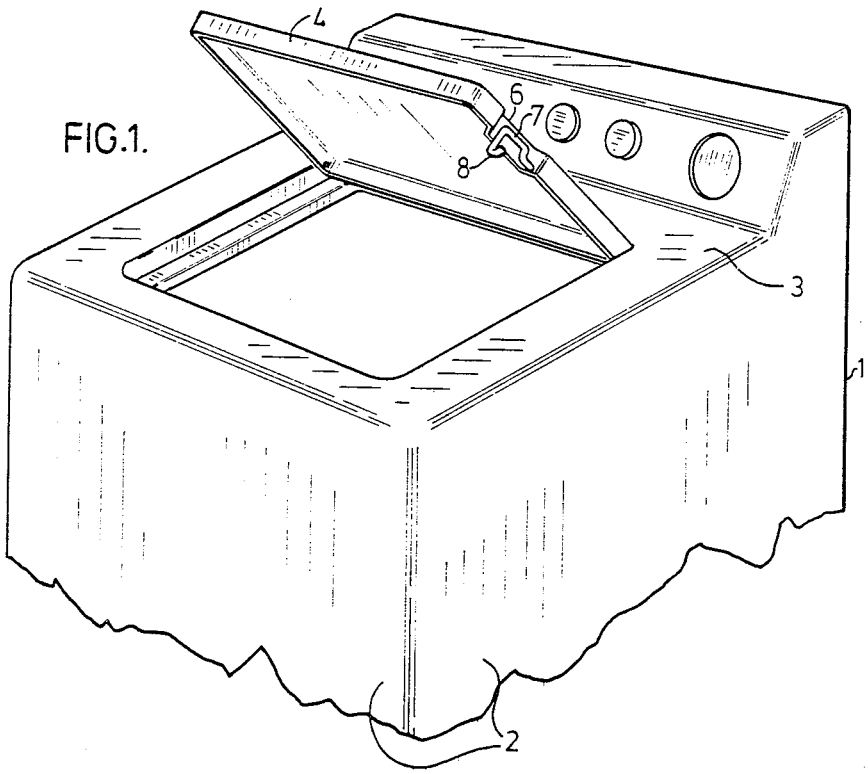
FIG. 1 is a perspective view of the top of a clothes cleaning appliance equipped with an embodiment of the present invention.
Figure 2:
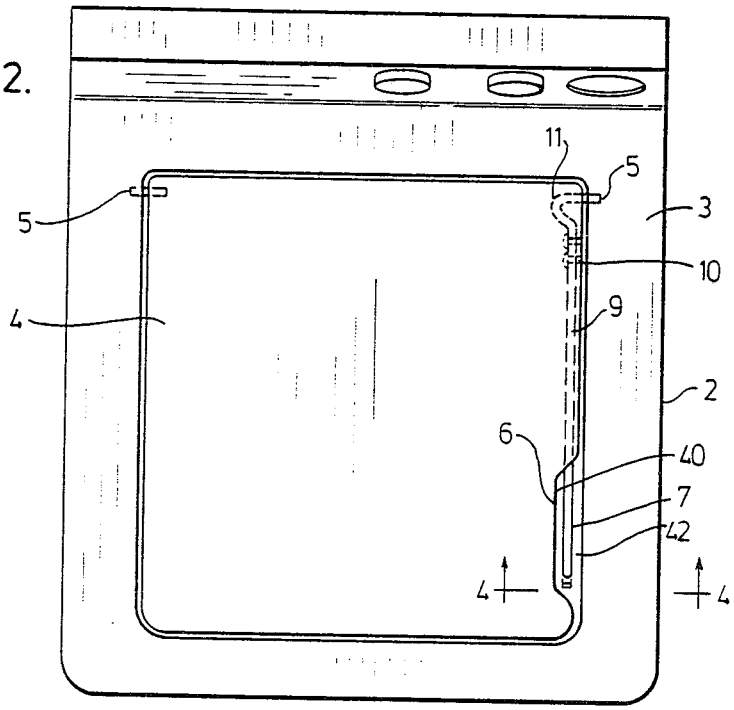
FIG. 2 is a top plan view of the clothes cleaning appliance illustrated in FIG. 1.

In FIGS. 1 and 2 an automatic clothes washing machine is illustrated having a housing 1, the housing having side walls 2 and top surface 3. A door 4 is hingedly secured to the housing 1 by hinges 5. A recess generally indicated at 6 is provided in the edge of one side of the door, the recess being defined by the edge of the door 40 and the adjacent edge of the top surface 3 of the housing 1. A latch according to one embodiment of the invention is provided for the door. The latch comprises a handle 7 which is located in the recess 6 in the edge of the door and a catch 8 which is depending from one end of the handle. In FIG. 2 the dotted lines indicate that the latch further comprises a portion 9 which is secured to the door by screws, bolts or rivets indicated at 10 thereby providing a means mounting the handle to the door. The latch is further provided with a curved portion 11 which is adapted to form one of the hinges 5 for the door. In the embodiment illustrated the latch is a formed metal rod, however, it could be of any material such as plastic which would have the necessary strength and rigidity to act as a handle and catch for the door.

Figure 3:
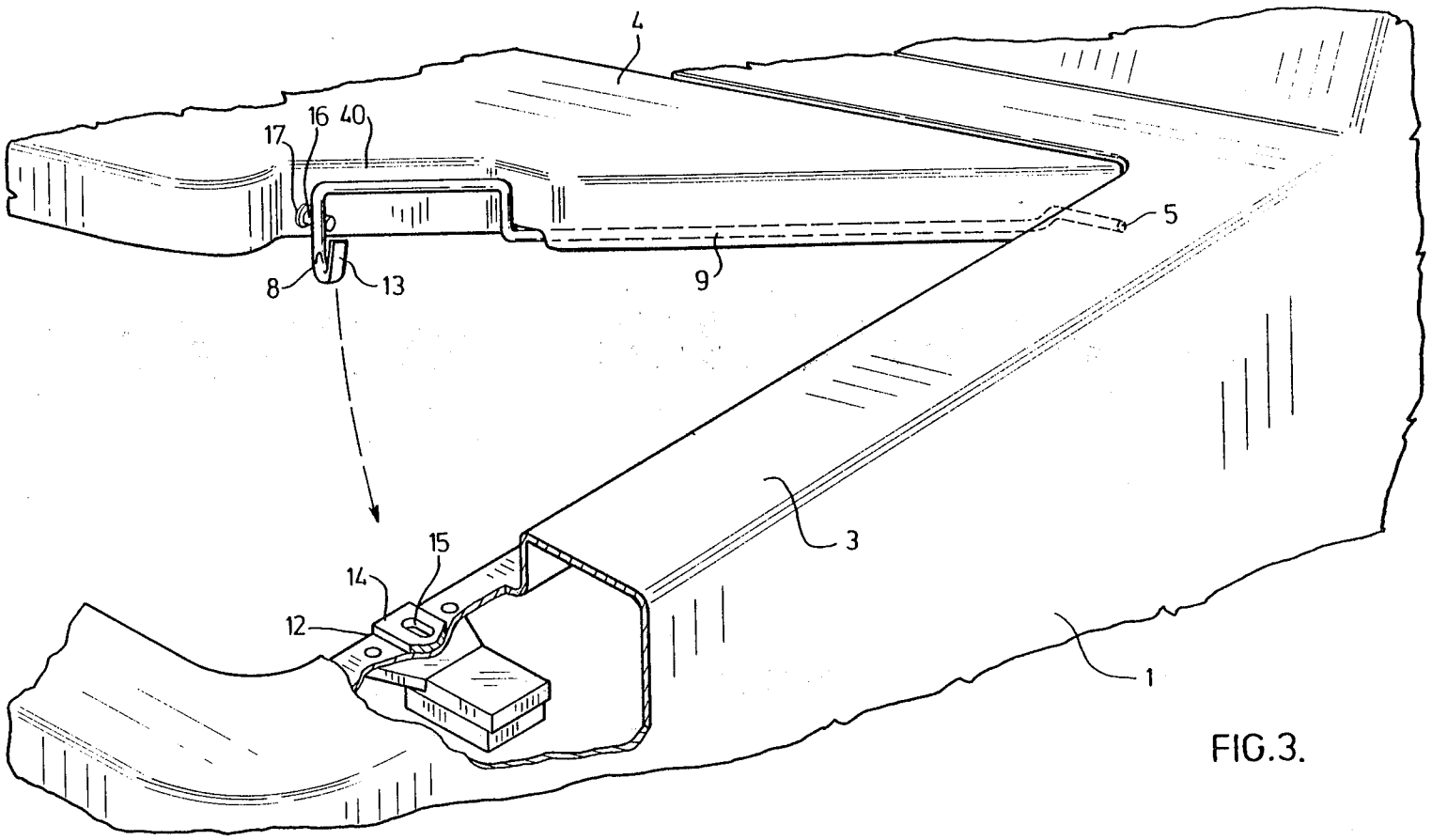
FIG. 3 is a perspective view partly in section of the embodiment shown in FIG. 1.
Figure 4:
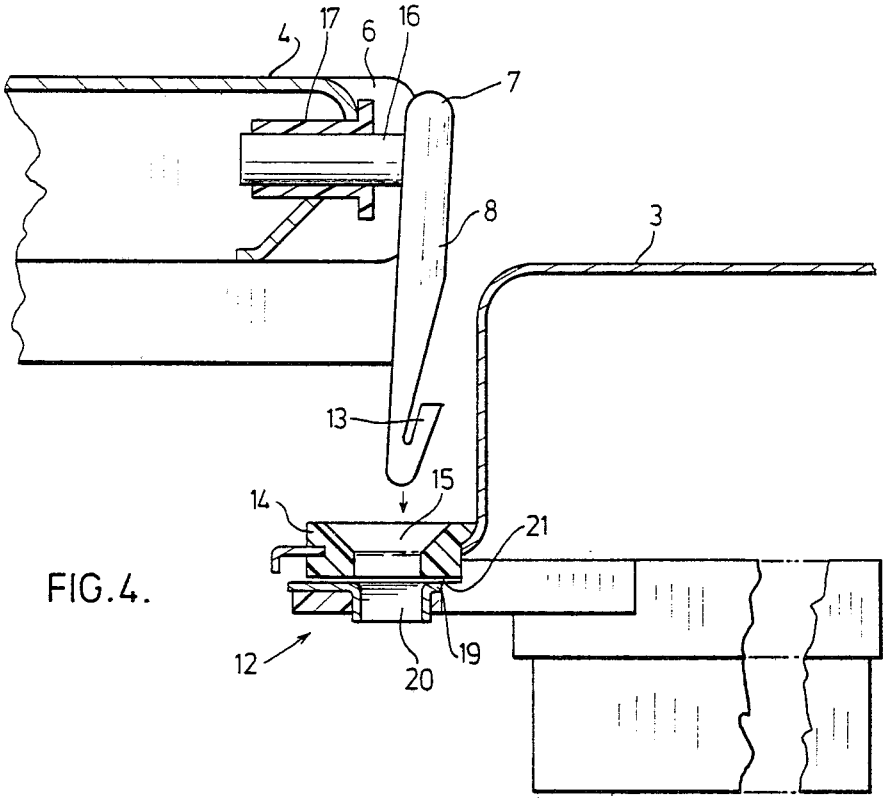
FIG. 4 is a view taken along the lines 4—4 of FIG. 2 where the lid is slightly open.
Figure 5:
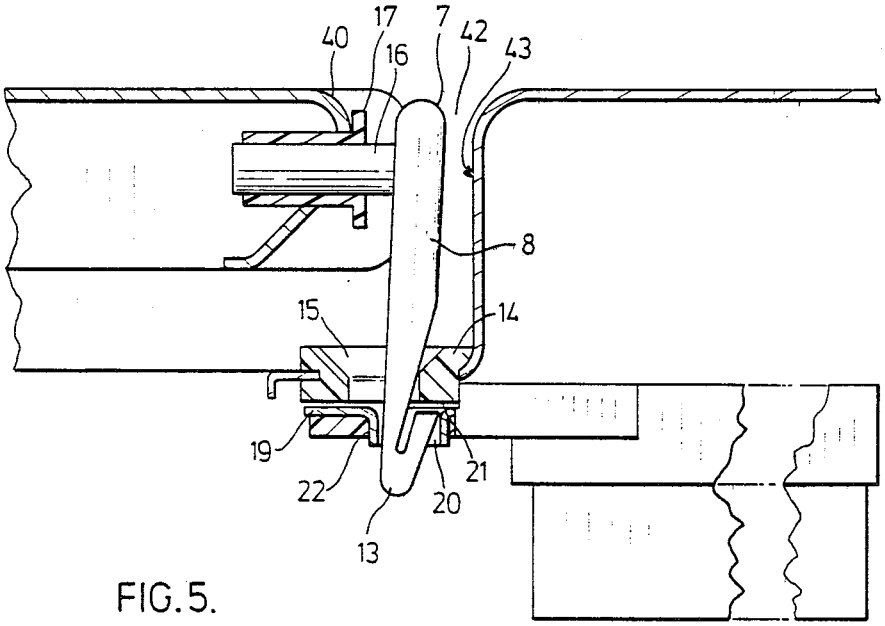
FIG. 5 shows the view of FIG. 4 with the lid closed and the catch operatively engaged with the locking means.
Figure 6:
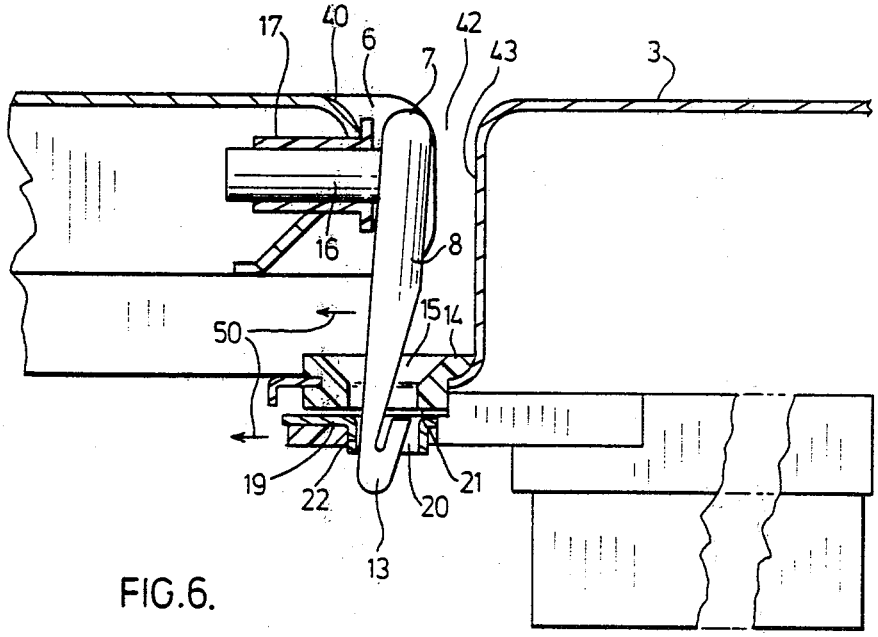
FIG. 6 shows the view of FIG. 4 with the lid closed and the latch released.
Figure 7:
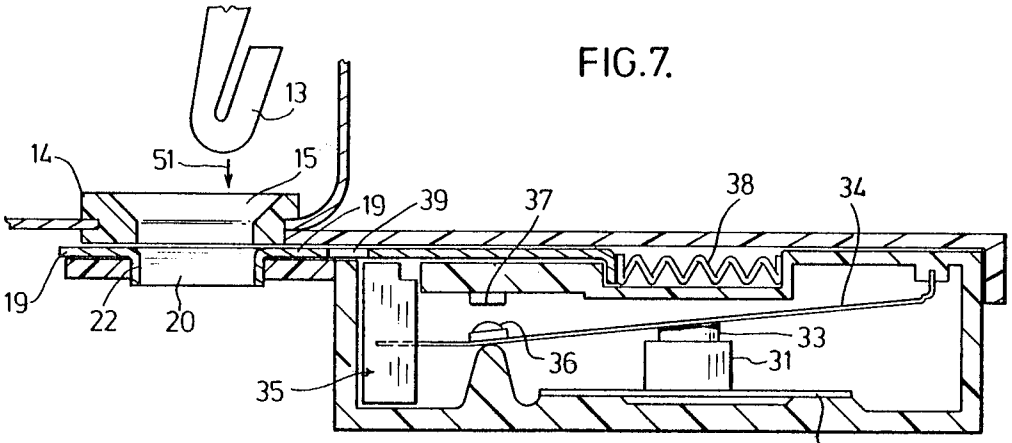
FIG.7 is a plan view of a timed-delay release locking device which can be used with this embodiment of the invention.
Figure 8:
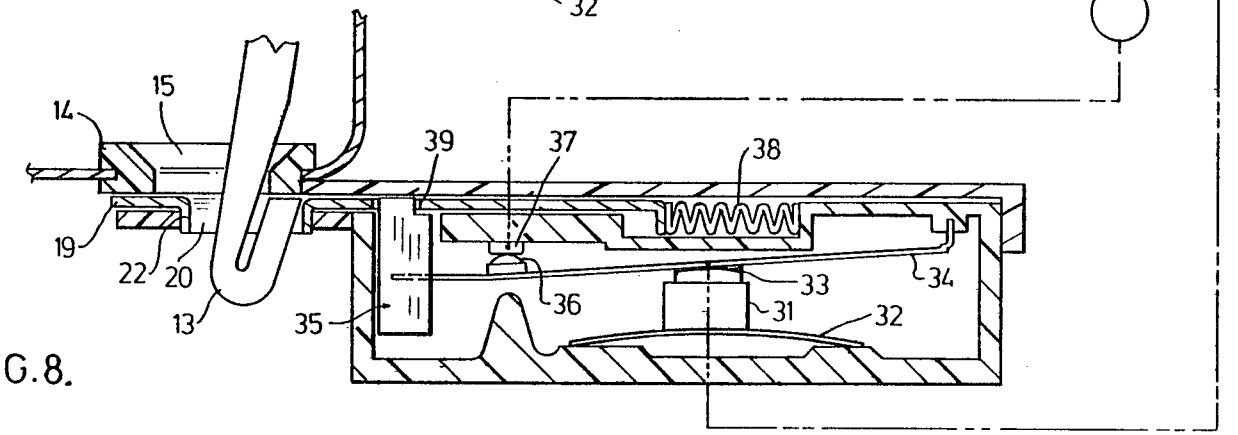
FIG. 8 is a further plan view of the time release locking means of FIG. 7 wherein the catch portion of the invention is locked in place.

In FIG. 3 a section has been removed from the housing 1 to show a locking means 12 located therein. The catch portion of the latch 8 has one end 13 hook-shaped and adapted to be secured under or by the locking means 12. The locking means illustrated is provided with selvedge 14 having an aperture 15 located therein. The catch 8, when the door is closed, projects through are, therefore, selected to dissipate thermal energy at a predetermined rate so as to ensure that pin 39 keeps the door locked for a sufficient period of time. A locking device of the type described above or any other similar time release mechanism, such as time delay locks based on a hydraulic or pneumatic delay, used with the embodiment of this invention as described above, provides a safe and efficient means in which to lock the door of a clothes washing appliance during the operation of the spin cycle. The latch formed as in the embodiment provides an easy to install, economical to produce and easy to operate combination catch and handle which will fit with any standard door of a washing machine having a recess located therein without the need of substantial additional tooling.

In FIGS. 9, 10 and 11 a second embodiment of the invention is illustrated. In the recess 6 of the door 4 of a washing machine is a closure generally indicated at 60. The closure 60 has a generally T-shaped cross-section with the hat or plate portion 61 of the T-substantially coplanar with the top surface of the door 4 and the adjacent housing top surface 3. The hat 61 of the T is adapted so that it fits within an indentation **6*a* in the top surface 3 of the housing. The stem 62 of the T is pivotally mounted at its base to the door 4 by a pin 63. Any other convenient means can be employed to pivotally mount the closure device 60 within the recess 6 of the door 4**.

A catch portion 64 integral with stem 62 depends from the base of the plate into the housing. The end 65 of the catch 64 projects into the housing through an aperture 66 located therein and is adapted to be latched under the surface of the housing 67 defining the aperture 66. In the embodiment illustrated, the end 65 is shaped to form a barb with the end tapered along edge 68 to provide a guiding surface to allow easy movement of the catch 64 in and out of the aperture 66.

A spring 69 is connected from the edge of the door 40 to the catch 64. The spring 69 or any other type of spring means functions to keep the catch 64 biased towards the position where the barb is under the surface of the housing 67 defining the aperture 66. This position is illustrated in FIG. 10.

A locking means generally indicated at 70 is located within the housing and is adapted to lock the catch 64 in the engaged position as illustrated in FIG. 10. The locking means is provided with a sliding plate 71 having an aperture 72 located therein. This aperture 72 is aligned with aperture 66 in the housing. The spring 69 causes the catch 64 to be pulled towards the door so that the end of the catch 65 will be engaged under the surface of the housing 67. The sliding plate 71 is adapted so that it is easily displaced to allow the end of the catch 65 to be operatively engaged. A second aperture 73 is provided in the sliding plate 71 and is positioned so that when the catch 65 is in the engaged position, a pawl 74 can project up into the aperture 73 thereby locking the sliding plate 71 in position. This is illustrated in FIG. 10. The first aperture 72 in the sliding plate 71 is sized so that insufficient space is provided when the plate is locked in position to allow the end of the catch 65 from being disengaged from under the surface of the housing 67 and allowing the door 4 to be opened. A mechanism, as described earlier, can be installed to control the movement of the pawl so that the door is locked at the desired times.

The closure illustrated in FIGS. 9, 10 and 11 is further described with reference to its mode of operation. The opening of the latch closure is illustrated in FIG. 11. The arrow 75 indicates that a downward force is applied to the part **61*a* of the hat of the T nearest the edge of the door 40. The plate 60 pivots or rocks about the pin 63 and a similar pin located at the other end of the closure. The downward movement of the first part 61*a* of the closure causes the second part 61*b* located adjacent to the top surface of the housing 3 to be lifted above the plane defined by the door 4 and the top surface of the housing 3. The length of this second part 61*b* of the plate is sized relative to the first part 61*a* to allow the second part 61*b* to be raised a sufficient distance above the housing 3 to allow a hand to grip the underside 61*c* of the plate. Therefore, the handle for the door is constituted by the underside 61*c*** of the closure device.

The end of the catch 65 has also been displaced so that it is disengaged from under the surface of the housing 67. In being disengaged, it has displaced the sliding plate 71 to allow the end of the catch 65 to be removed from within the housing and allow the door 4 to open. If the plate 71 is locked in position as illustrated in FIG. 10, the catch will not be allowed to move thereby preventing depression of the part **61*a* of the closure. The second part 61*b* of the handle will not be raised a sufficient distance above housing 3 so that the underside plate 61*c* of the plate can be gripped by a hand. As a result, access to the handle 61*c* of the closure is impeded or precluded due to the plate 61*b* being proximate the housing 3**.

The latch can be formed from a tough thermo plastic or other material that is regis and strong enough to withstand the abuse of day-to-day operation.

A third embodiment of the invention is illustrated in FIGS. 12, 13 and 14. A closure indicated generally at 100 is provided within the recess 6 of the door 4. The door 4 is equipped with a lip 101 along the edge of the door 40 within the recess 6 and the lip 101 functions as the handle for the door 4.

A barrier 102 prevents access to the lip 101. The barrier has a vertical section 103, a short horizontal section 104 adapted to fit over the lip 101 when the door 4 is closed and a second generally vertical section 105. This second vertical section 105 is slanted away from the door 4 to allow the lip 101 as the door is being closed, to cam the barrier 102 sideways allowing the door to be closed. After the door is closed, the horizontal section 104 acts as a catch to be engaged over the lip 101 preventing access to the handle for the door unless the barrier 102 is moved.

A rod 106 is connected to the barrier 102 and projects into the housing. A spring 107 is provided around the rod 106 and biases the barrier 102 towards the position whereby the horizontal section 104 would be engaged over the lip 101 of the door 4. This position is illustrated in FIG. 13.

A locking means generally indicated at 108 is located within the housing. A sliding plate 109 is connected to the rod 106. An aperture 110 is located in the plate 109 through which a pawl 111 can project to lock the plate 109 in position. A projection 112 on the plate 109 limits the distance the plate 109 can move ensuring the barrier 102 is in a position so that when the door is opened, the lip 101 can meet the second vertical section 105 at a point where the lip 101 is able to displace the barrier 102 as the door is closed. A mechanism, as described above, can be provided to control the pawl 111 so that the door is locked at the desired times.

The operation of the closure is illustrated in FIG. 14. Arrows 113 indicate that the barrier 102 is displaced and kept displaced a sufficient distance to disengage the horizontal section 104 from the top of lip 101 and to allow sufficient space between the lip 101 and the barrier 102 to allow a hand of the operator to grip under the lip 101 to open the door. Arrow 114 and the door represented in dotted lines indicated that the door is opening. After the door is open, the barrier 102 returns, due to spring 107 to a position determined by stop 112. This position is such that pin 111 will not line up with aperture 110. Pin 111 may be designed such that it only closes a switch to permit activation of the spin cycle when it extends through aperture 110 of the sliding plate 109. Therefore, activation of the spin cycle can only occur when the door is closed, so that the catch has aligned aperture 110 with the pin 111. The barrier 102 can be formed of any material having sufficient rigidity and strength to withstand the abuse of day-to-day operation such as a tough thermo plastic or metal.

This type of closure or latch may be used on several types of clothes cleaning devices, such as top and front loading washing machines, clothes dryers and clothes cleaning devices. The lock which secures the catch of the latch may be actuated and remain actuated during portions of the cycle which could bring about bodily injury or result in spills should the door be opened. For example, with a front loading washing machine, it is important to ensure that the door cannot be opened until substantially all water has been drained from the basket or is below the level of the door. During the spin cycle of an automatic washer, it is important to ensure that no access is gained to the spinable drum until after the brake mechanism has brought the drum to rest on completion of the spin cycle. A further consideration could be that this system be designed to eliminate the need for a brake mechanism on an automatic washer. It is understood that the drum, on completion of the spin cycle would eventually stop spinning if not braked. This period of spin stoppage in absence of braking may be approximately 1 to 2 minutes. Therefore, the timed delay on latch release could be slightly greater than the anticipated period for the spinning basket to come to rest. As a result, access to the basket would not be permitted until it had come to rest. This eliminates the need for the very costly brake mechanism on the machine. Other examples are in dry cleaning equipment, where it is important not to gain entry to the machine until all hazardous vapours have been evacuated. It is, therefore, apparent that the lock may be controlled by a device which will only release the catch of the latch when the above type of cycle in cleaning clothes has been completed.

With the handle, a barrier and catch of this invention and this relationship to the door and housing of the machine, one is not able to grasp the handle while the catch is secured by the locking means due to the obstacle provided by the barrier. It is, therefore, apparent that this type of closure provides the added safety feature in not presenting a handle for the door which would allow a person to open or force open the door thereby to gain accesss during for example, a hazardous portion of the clothes treating cycle. This type of closure provides the only form of access to opening the door, since the remaining part of the door is free of any other items which would provide a portion to manually open the door.

Various types of clothes cleaning devices have been discussed with regard to the closure of this invention. It is appreciated that a particular advantageous use of this closure is on coin operated machines in laundromats. This type of machine is usually subjected to a fair amount of abuse and is not always used with the proper amount of caution. Therefore, this type of closure system enhances the safety aspects of coin operated washing machines, because it further reduces the likelihood of someone being injured during the hazardous spin cycle of a top loading machine. The closure is also useful on coin operated front loading machines with respect to the spin cycle and also during the washing cycle to preclude people opening the front door during this cycle which could result in embarrassing spills.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In an appliance for cleaning and treating clothes having a housing, a door with a handle portion being mounted on said housing over an opening to control access to within said appliance, and a closure for said door, said closure comprises means for impeding access to said handle portion for said door, a catch for releasably securing said door shut and means for locking said said catch, said impediment means being manually moveable to gain access to said handle where such movement releases said catch when unlocked, the arrangement being such that when said catch means is locked, movement of said impediment means to gain effective handle access is prevented.

2. In an appliance of claim 1, said locking means having a time delay release for locking said catch to thereby preclude access to said handle.

3. In an appliance for cleaning clothes having a housing, a door hingedly secured to the housing, said door providing access to a cleaning chamber located in the housing, said door having an indentation on one side to define a recess between door and housing and a latch for said door, said latch comprising a handle portion with a depending catch portion and means for mounting the latch to the door, said catch portion being adapted to be engaged by locking means located in the housing, said latch being biased in a manner whereby the catch portion is engaged by the locking means when the door is closed, the graspable portion of said handle being positioned within the door recess which allows the handle to be moved sideways to disengage the catch and the perimeter of such limiting access to the graspable handle portion when the door is closed and the catch is secured by the locking means.

4. In an appliance of claim 3, further comprising guide means connected to the handle portion and adapted to fit within a portion of the door to guide and support the movement of the handle when the catch is disengaged.

5. In an appliance of claim 3, the means for mounting the handle to the door comprises a rod, one end of said rod connected to the handle, the other end of said rod secured to the door, said rod located inside said lid and positioned so as to project out of said lid at the point where the handle connects to said rod, said rod providing the bias for the latch as it flexes along its length during lateral movement of handle.

6. In an appliance of claim 3, said locking means located in the housing is actuable to secure said catch and hold it thereby preventing sideways movement of said handle, said locking means comprising means which provides a time delay for unlocking said catch a predetermined period of time after completion of an appliance cycle which had caused actuation of said locking means, said unlocking permitting sideways movement of handle to thereby release the latch for door opening.

7. In an appliance of claim 3, the means for mounting the handle to the door being adapted to function as one of the hinges for the door.

8. In an appliance of claim 1, access to the handle being limited by positioning the handle portion in close proximity to the adjacent edge of the housing, the graspable portion of the handle being below a plane defined by the top surface of said housing, the handle being graspable when deflected laterally away from said housing.

9. In an appliance for cleaning clothes having a housing a door hingedly secured to the housing, said door providing access to the cleaning chamber located in the housing, said door also provided with a recess on one side, a unitary handle, catch and hinge for said door wherein a single rod is formed to provide a catch portion connected to said handle and a hinge portion connected to said handle by a length of said rod, said length of rod being secured to said door adjacent said hinge portion, said handle portion being positioned in the recess as said rod extends out of said door, said catch portion adapted to be engaged by locking means located in the housing opposite said catch, the arrangement being such that the length of rod resiliently allows the handle to be moved laterally within the recess, said lateral movement of said handle operating so as to disengage the catch from the locking means when the door is closed, access to the handle being limited when the door is closed and the catch is operatively secured by said lock.

10. In an appliance of claim 9, said length of rod being sufficient to prevent permanent rod deformation during rod flexing as the handle is moved to release the latch.

11. In an appliance of claim 9 or 10, further comprising a guide means connected to said handle, said guide means adapted to project into the sidewall of said recess to guide and support lateral movement of said handle.

12. In an appliance of claim 9 or 10, the manually graspable portion of said handle being below a plane defined by the top surface of said housing where the spacing between handle and housing is less than finger width, said handle being graspable when the catch is unlocked and the handle is free to be moved sideways within the confines of said recess.

13. In an appliance for cleaning clothes having a housing, a door hingedly secured to the housing, said door providing access to a cleaning chamber located in the housing, said door having an indentation on one edge to define a recess between door and housing, and a closure for said door, said closure comprising a catch and a barrier, said catch adapted to latch the door closed, said barrier mounted within the recess of the door and adapted to be moveable within said recess, the movement of the barrier from the position where the catch is engaged to latch the door being such that the catch is released and access is provided to a handle for said door, the access to said handle being impeded by the barrier when the catch is operatively engaged to keep the door closed, and means adapted to return the barrier to the position where the catch is operatively engaged from the position where the catch is released.

14. In an appliance of claim 13, the closure further comprising locking means adapted to lock the barrier in position whereby the door is locked shut and where access to the handle for the door is prevented.

15. In an appliance of claim 13, where the handle for said door is a lip on the top edge of said door defining the recess.

16. In an appliance of claim 13, where the catch engages over the top surface of the door to latch it closed.

17. In an appliance of claim 13, the closure further comprising a handle for said door.

18. In an appliance of claim 14, said locking means being adapted to provide a time delay for unlocking the catch, the time delay being such to unlock the catch a predetermined period of time after completion of an appliance cycle which has caused actuation of the locking means.

19. In an appliance for cleaning clothes having a housing, a door hingedly secured to the housing, said door providing access to a cleaning chamber located in the housing, said door having an indentation on one side to define a recess between door and housing and a latch for said door, said latch comprising a handle portion, and a depending catch portion, the catch adapted to project into the housing and be engaged by locking means located therein, said handle adapted to be mounted within said recess to allow movement thereof, said movement of the handle releasing the catch from an operatively engaged position whereby the door is latched closed and said movement also providing access to the handle, said access impeded when the catch is operatively engaged, and said latch spring biased towards the position whereby the catch is operatively engaged.

20. In an appliance of claim 19, said handle being T-shaped, the hat of said T being coplanar with the top surface of said door and the top surface of housing, said handle pivotally mounted in said recess such that one side of said hat may be depressed causing the handle to pivot, releasing the catch and raising the other side of said hat to provide a functional handle for said door.

21. In an appliance of claim 19, the locking means being provided with a time delayed release.

22. In an appliance of claim 19, said handle being constituted by the underside of a plate portion mounted in said recess to rock about an axis along its length, said catch portion depending from the underside of said plate, a rocking movement of said plate releasing said catch and providing access to its underside.

23. In an appliance of claim 6, 18 or 21, said appliance being adapted to wash clothes, wherein a spin cycle is used to centrifuge said clothes, a drum in which such clothes are contained being free to cease rotation on its own after completion of the spin cycle, the period of time delay being greater than the predetermined period of time needed for such drum to cease rotation.

* * * * *